US009016887B2

(12) United States Patent
Weinrich

(10) Patent No.: US 9,016,887 B2
(45) Date of Patent: Apr. 28, 2015

(54) FLASHLIGHT SLEEVE

(71) Applicant: Matthew Weinrich, Richland Hills, TX (US)

(72) Inventor: Matthew Weinrich, Richland Hills, TX (US)

( * ) Notice: Subject to any disclaimer, the term of this patent is extended or adjusted under 35 U.S.C. 154(b) by 63 days.

(21) Appl. No.: 13/866,104

(22) Filed: Apr. 19, 2013

(65) Prior Publication Data

US 2013/0279158 A1 Oct. 24, 2013

Related U.S. Application Data

(60) Provisional application No. 61/635,991, filed on Apr. 20, 2012.

(51) Int. Cl.
*F21V 21/40* (2006.01)
*F21L 4/00* (2006.01)

(52) U.S. Cl.
CPC ..... *F21V 21/406* (2013.01); *F21L 4/005* (2013.01)

(58) Field of Classification Search
CPC ..... F21V 21/40; F21V 21/406; F21V 21/00; F21L 4/00; F21L 4/005
See application file for complete search history.

(56) References Cited

U.S. PATENT DOCUMENTS

| | | | | |
|---|---|---|---|---|
| 4,415,954 | A | 11/1983 | Schaefer | |
| 5,188,450 | A | 2/1993 | Anderson | |
| 5,471,374 | A * | 11/1995 | Palmer | 362/191 |
| 5,921,657 | A | 7/1999 | Case | |
| 5,947,585 | A | 9/1999 | Hill | |
| 6,769,788 | B1 * | 8/2004 | Kellough | 362/208 |
| 6,921,181 | B2 | 7/2005 | Yen | |
| 7,744,239 | B2 * | 6/2010 | Bono | 362/205 |
| 7,837,346 | B2 * | 11/2010 | Griffin | 362/191 |
| 2014/0111981 | A1 * | 4/2014 | Watanabe | 362/184 |

* cited by examiner

*Primary Examiner* — Bao Q Truong
(74) *Attorney, Agent, or Firm* — Buckingham, Doolittle & Burroughs, LLC

(57) ABSTRACT

A gripping device is disclosed that provides police officers, security guards, hunters, homeowners, and anyone else who uses a long-handled flashlight with an easy, insulated, comfortable, glow-in-the-dark way to get a good tactical grip on the flashlight. The gripping device comprises a flexible sleeve member that is expandable for receiving at least a portion of the main body of the flashlight. The flexible sleeve member comprises open, opposing ends, and is tubular in shape with a generally circular outer circumference. The exterior surface of the flexible sleeve member comprises a plurality of recessed finger and thumb grooves for easily gripping the flashlight, and a smooth cushioned area for allowing a user to hold the flashlight between a chin and a shoulder. Further, the recessed finger and thumb grooves comprise glow-in-the-dark phosphorescent cell inlays to illuminate the flashlight at night or in low light areas.

12 Claims, 5 Drawing Sheets

FLASHLIGHT SLEEVE

CROSS-REFERENCE

This application claims priority from Provisional Patent Application Ser. No. 61/635,991 filed Apr. 20, 2012.

BACKGROUND

Many police officers, security guards, hunters, homeowners, and other personnel use a specific type of aluminum-bodied, long-handled flashlight for their jobs. These flashlights are convenient, but they can also pose some problems. For example, the handles of these flashlights can become extremely cold if used outside during the winter and/or used at night. Further, if a user grabs onto the flashlight handle or tries to balance the flashlight between their chin and shoulder, the user can be distracted by the uncomfortable coldness of the handle. The handle can also be hard, heavy, and slick, making it difficult to grab and secure. Additionally, it can be difficult to try to find these flashlights in the dark, as they have no illuminating properties. Thus, an effective solution is necessary.

There is a need for a device that provides police officers, security guards, hunters, homeowners, and anyone else who uses a specific aluminum-bodied, long-handled, flashlight with an easy, insulated, comfortable, glow-in-the-dark way to get a good tactical grip on the flashlight. The present invention comprises a silicone molded sleeve-like device that can fit over the handle of these flashlights. By using this device, users can easily wedge the flashlight between their chin and shoulder in order to manipulate the light while using both hands to write a ticket, for example. Due to its added wedging ability, the gripping device can also prevent the flashlight from rolling around on the floor or console of a car, van, or truck, as well as can allow users, particularly security personnel not permitted to carry a firearm, to grip the flashlight quickly and firmly in any self-defense situation and for use as a weapon. Additionally, the gripping device can have glow-in-the dark properties, allowing for quick location and finger placement in dark areas. This device can also be ideal for homeowners, hunters, and a variety of other users looking to improve the functionality of their aluminum-bodied, long-handled flashlights.

SUMMARY

The following presents a simplified summary in order to provide a basic understanding of some aspects of the disclosed innovation. This summary is not an extensive overview, and it is not intended to identify key/critical elements or to delineate the scope thereof. Its sole purpose is to present some concepts in a simplified form as a prelude to the more detailed description that is presented later.

The subject matter disclosed and claimed herein, in one aspect thereof, comprises a gripping device that provides police officers, security guards, hunters, homeowners, and anyone else who uses a long-handled flashlight with an easy, insulated, comfortable, glow-in-the-dark way to get a good tactical grip on the flashlight. The gripping device comprises a flexible sleeve member that is expandable for receiving at least a portion of the main body of the flashlight and that insulates the main body of the flashlight. The flexible sleeve member comprises open, opposing ends, and is tubular in shape with a generally circular outer circumference. The exterior surface of the flexible sleeve member comprises a plurality of recessed finger and thumb grooves for easily gripping the flashlight. The exterior surface further comprises a smooth cushioned area for allowing a user to hold the flashlight between a chin and a shoulder.

In a preferred embodiment, the interior surface of the flexible sleeve member comprises a textured pattern that enables the flexible sleeve member to grip the main body of the flashlight via friction. Further, the recessed finger and thumb grooves comprise glow-in-the-dark phosphorescent cell inlays to illuminate the flashlight at night or in low light areas. Additionally, the exterior surface of the flexible sleeve member comprises a cut-out to accommodate the thumb operated on-off button.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and is intended to include all such aspects and their equivalents. Other advantages and novel features will become apparent from the following detailed description when considered in conjunction with the drawings.

DESCRIPTION OF PREFERRED EMBODIMENTS

Figure 1:
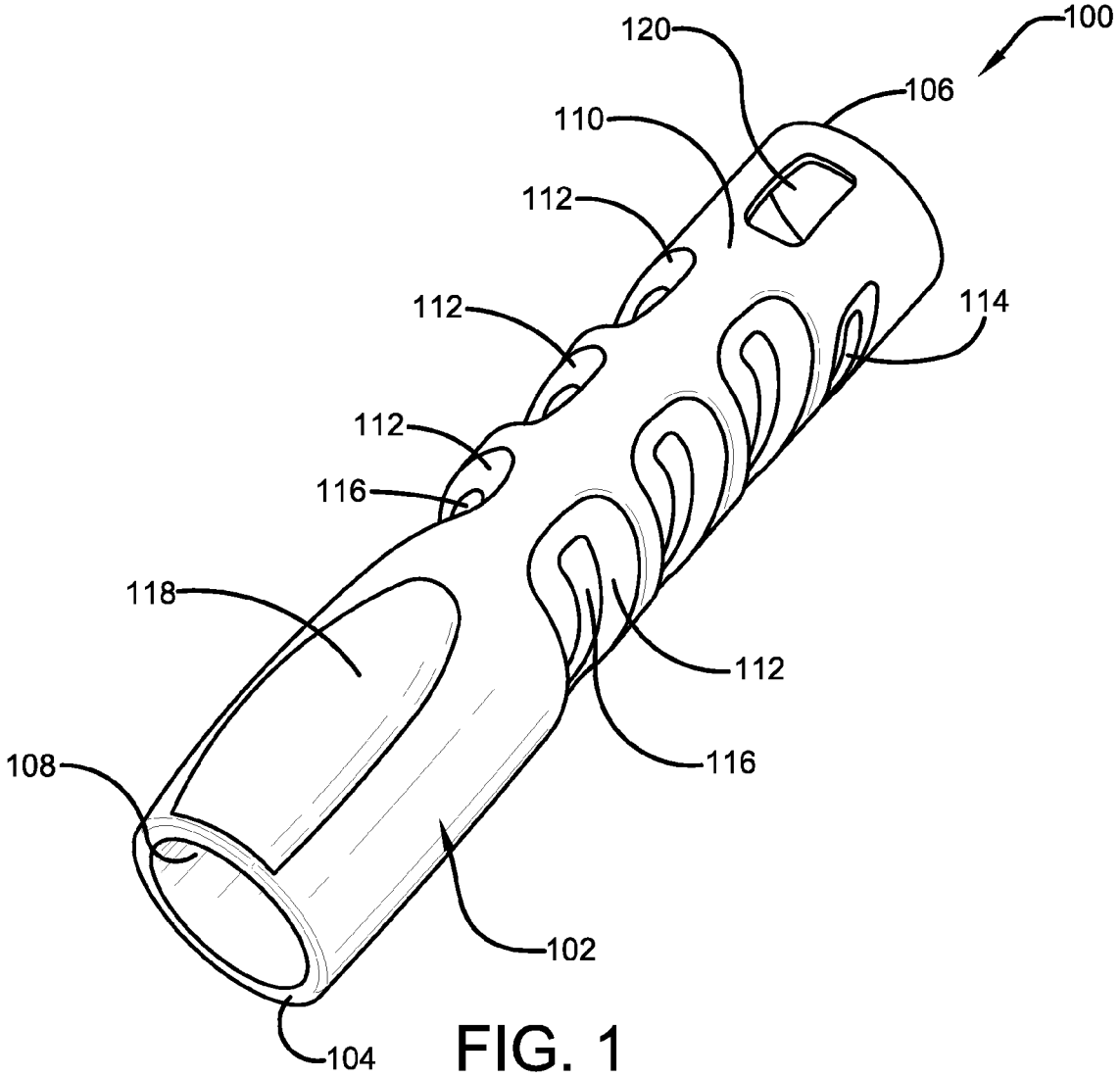
FIG. 1 illustrates a perspective view of the gripping device in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof.

The present invention discloses a gripping device that is used to provide users with an easy, insulated, comfortable, glow-in-the-dark way to get a good tactical grip on a flashlight. The device allows users to easily wedge the flashlight between their chin and shoulder in order to manipulate the light while freeing their hands. Further, the gripping device prevents the flashlight from rolling around on the floor or console of a vehicle, or other horizontal surface. The gripping device allows users, particularly security personnel not permitted to carry a firearm, to grip the flashlight quickly and firmly in any self-defense situation. Typically, this device improves the functionality of aluminum-bodied, long-handled flashlights.

The disclosed gripping device comprises a flexible sleeve member that is expandable for receiving at least a portion of the main body of the flashlight. The flexible sleeve member comprises open, opposing ends, and is tubular in shape with a generally circular shaped outer circumference. The exterior surface of the flexible sleeve member comprises a plurality of recessed finger and thumb grooves for easily gripping the flashlight, and a smooth cushioned area for allowing a user to hold the flashlight between a chin and a shoulder. Further, the recessed finger and thumb grooves comprise glow-in-the-dark phosphorescent cell inlays to illuminate the flashlight and allow for quick location and finger placement in dark or dimly lit areas.

Figure 2:
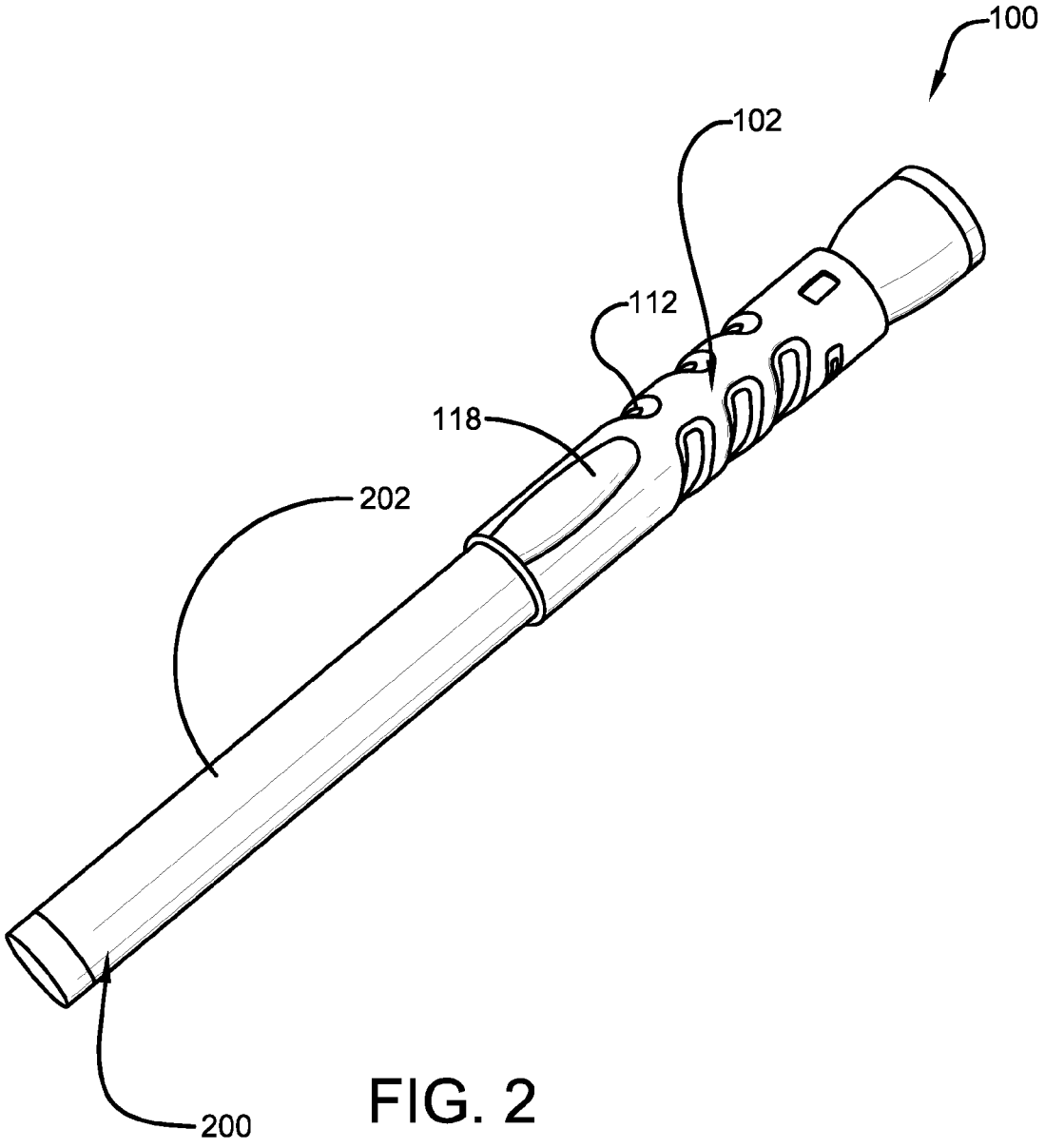
FIG. 2 illustrates a perspective view of the gripping device secured to a flashlight in accordance with the disclosed architecture.
Figure 3:
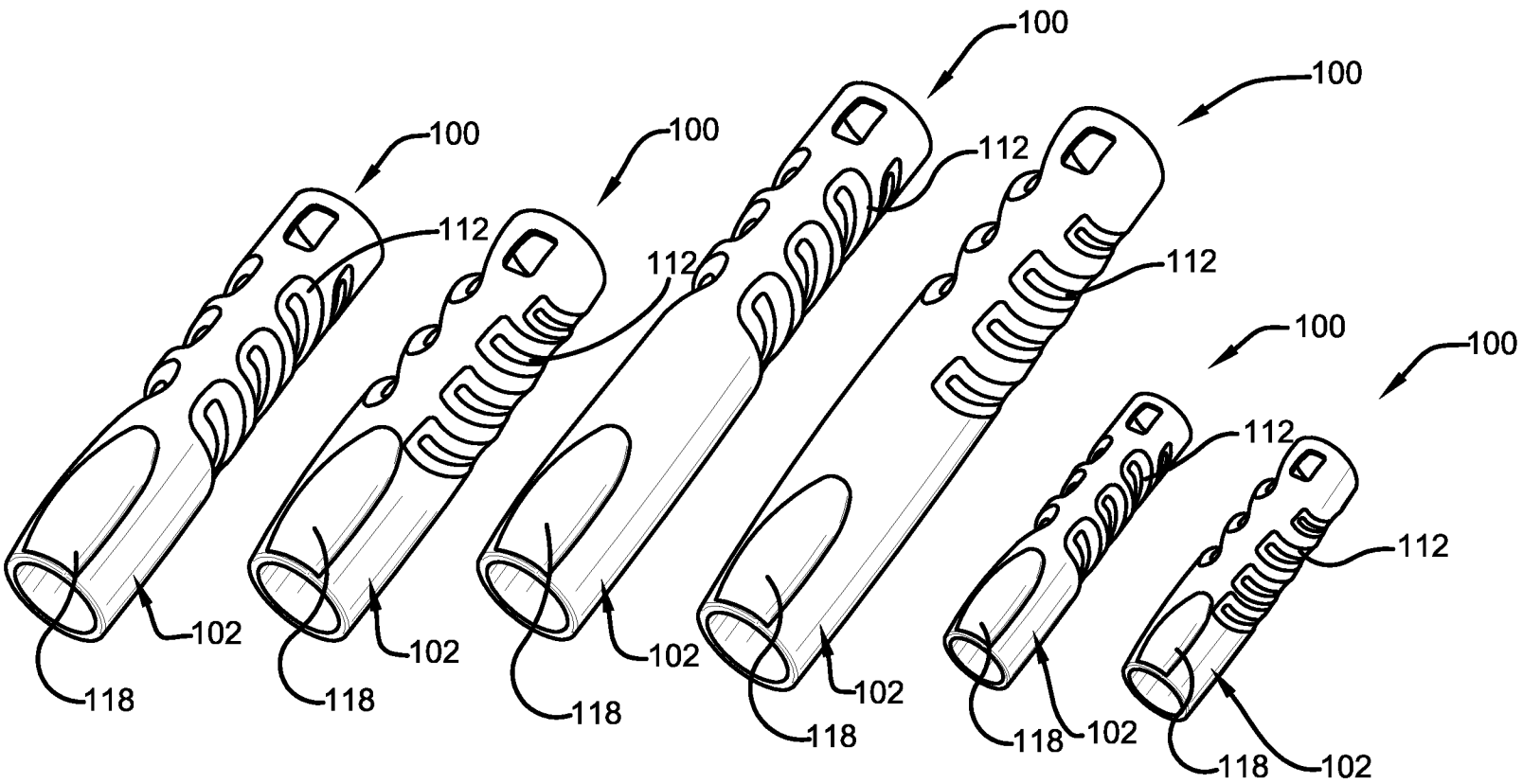
FIG. 3 illustrates a perspective view of the gripping device showing various designs and colors in accordance with the disclosed architecture.

Referring initially to the drawings, FIGS. 1-3 illustrate the gripping device 100 that provides police officers, security guards, hunters, homeowners, and anyone else who uses a long-handled, flashlight with an easy, insulated, comfortable, glow-in-the-dark way to get a good tactical grip on the flashlight. The gripping device 100 comprises a flexible sleeve member 102 that is expandable for receiving at least a portion of the main body (or barrel) of a prior art flashlight 200 (as shown in FIG. 2).

The flexible sleeve member 102 comprises a first open end 104, an opposed second open end 106, an interior surface 108 and an exterior surface 110 (as shown in FIG. 1). Typically, the flexible sleeve member 102 is tubular or cylindrical in shape and comprises a generally circular outer circumference, however any other suitable shape can be used as is known in the art without affecting the overall concept of the invention. The flexible sleeve member 102 would generally be constructed of silicone, neoprene, fluoropolymer elastomers, or any other similar rubber-like materials, etc., though any other suitable material may be used to manufacture the flexible sleeve member 102 as is known in the art without affecting the overall concept of the invention. Further, the silicone (or suitable material) of the flexible sleeve member 102 insulates the main body 202 of the flashlight 200, allowing a user to have a good tactical grip on the flashlight 200 and preventing the main body 202 from becoming cold. Thus, if the user grabs onto the main body 202 of the flashlight 200 or tries to balance the flashlight 200 between their chin and shoulder, the user is not distracted by the uncomfortable coldness of the flashlight 200.

The flexible sleeve member 102 can also comprise a variety of colors and designs to suit user and manufacturing preference. Specifically, the flexible sleeve member 102 can comprise different color schemes, transparent coloring, and tactical coloring, as well (as shown in FIG. 3). The flexible sleeve member 102 is approximately between 3 and 18 inches long as measured from the first open end 104 to the second open end 106, and approximately between 0.561 and 1.58 inches in diameter. However, the flexible sleeve member 102 can be any suitable length and diameter, depending on the size and shape of the flashlight 200 with which it is being used.

Typically, the flashlight 200 is an aluminum-bodied, multiple D-cell powered or C-cell powered, long-handled flashlight, such as a Maglite® flashlight or any other suitable flashlight as is known in the art. Specifically, the flexible sleeve member 102 is expandable for receiving at least a portion of the main body 202 (or barrel) of the flashlight 200 (as shown in FIG. 2). The silicone of the flexible sleeve member 102 insulates the main body 202 of the flashlight 200, allowing a user to have a good tactical grip on the flashlight 200. The flexible sleeve member 102 would be slid into place on the flashlight 200 via soap and water and once dry, would conform to the contours of the flashlight 200. Specifically, the knurling of the flashlight main body 202 would be matched to the knurling on the interior surface of the flexible sleeve member 102. Once in place, the flexible sleeve member 102 is meant to be permanently attached to the flashlight 200. However, if needed, the flexible sleeve member 102 can be removed from the main body 202 by grasping an end of the flexible sleeve member 102 and pulling toward the user.

The interior surface 108 of the flexible sleeve member 102 can comprise a textured pattern (not shown), or any other suitable irregular or uneven surface as is known in the art. The textured pattern enables the flexible sleeve member 102 to grip (or secure to) the main body 202 of the flashlight 200 via frictional contact (i.e., the sleeve member is secured via a friction fit). Generally, the interior surface 108 of the flexible sleeve member 102 comprises a textured crosshatch pattern to secure the flexible sleeve member 102 to the main body 202 of the flashlight 200 while in use.

The exterior surface 110 of the flexible sleeve member 102 comprises a plurality of recessed finger grooves 112 and recessed thumb grooves 114. The recessed finger 112 and thumb 114 grooves provide the flexible sleeve member 102 with an ergonomic shape, that allows a user to easily grip the flashlight 200. The plurality of recessed finger 112 and thumb 114 grooves can be positioned in any suitable location on the exterior surface 110 of the flexible sleeve member 102, and in any suitable arrangement that meets the needs and desires of a user. Further, the recessed finger 112 and thumb 114 grooves can be any suitable size as is known in the art, as long as the recessed grooves 112 and 114 are able to cushion the fingers and/or thumb of a user. Additionally, the recessed grooves 112 and 114 provide a wedging ability that prevents the flashlight 200 from rolling around on the floor, console of a vehicle, or other horizontal surface. Due to the flashlight's size and their long-weighted and slick handles (main body), the flashlight 200 tends to roll around the floor, console of a vehicle, or other horizontal surface and gain momentum while doing so. Thus, the recessed grooves 112 and 114 of the flexible sleeve member 102 provide traction and prevent the flashlight 200 from rolling.

The recessed finger 112 and thumb 114 grooves can also comprise a gelatinous substance (not shown), or any other soft, easily deformable elastic or visco-elastic cushioning media as is known in the art, that cushions the user's fingers/thumbs and further provides for a comfortable and ergonomic grip of the flashlight 200. Typically, the recessed finger 112 and thumb 114 grooves comprise a gelatinous substance, however, any other location on the exterior surface 110 of the flexible sleeve member 102 can comprise a gelatinous substance to cushion the user's hands, fingers, thumbs, etc., and to provide for a more comfortable and ergonomic grip of the flashlight 200.

Additionally, the recessed finger 112 and thumb 114 grooves can comprise glow-in-the-dark phosphorescent cell inlays 116, or any other suitable glow-in-the-dark or luminescent materials to illuminate the flashlight 200 at night or in low light areas. Typically, the recessed finger 112 and thumb 114 grooves comprise glow-in-the-dark phosphorescent or luminescent materials, however, any other location on the exterior surface 110 of the flexible sleeve member 102 can comprise glow-in-the-dark phosphorescent or luminescent materials to illuminate the flashlight 200 as well.

The exterior surface 110 of the flexible sleeve member 102 can further comprise a smooth cushioned area 118 for allowing a user to hold the flashlight 200 between a chin and a shoulder. Typically, the smooth cushioned area 118 is positioned on the exterior surface 110, opposite of the plurality of recessed finger 112 and thumb 114 grooves, however the smooth cushioned area 118 can be positioned at any location on the exterior surface 110 of the flexible sleeve member 102 to cushion the chin and/or shoulder of a user. Further, the smooth cushioned area 118 can be any suitable size as is known in the art, as long as the smooth cushioned area 118 is able to cushion the chin and/or shoulder of a user.

The exterior surface 110 of the flexible sleeve member 102 can further comprise a cut-out 120 to accommodate the thumb operated on-off button. The cut-out 120 can be positioned anywhere on the exterior surface 110 of the flexible sleeve member 102, as long as the cut-out 120 is directly over the on-off button, exposing the button. Further, the cut-out 120 can be any suitable size, as long as the cut-out 120 is large enough to allow a user to operate the on-off button. Specifically, the cut-out 120 enables a user to depress the on-off button, and thus turn the flashlight 200 on and off, without removing the flexible sleeve member 102.

Additionally, the flexible sleeve member 102 and flashlight 200 can be secured in a holster (not shown), and then attached to a user's sleeve or clipped to a user's waist belt, or secured to any other suitable position on a user's body. The holster can be any suitable holster as is known in the art. Further, the flexible sleeve member 102 and flashlight 200 can also be secured directly to the user without use of a holster, via any suitable securing means as is known in the art without affecting the overall concept of the invention.

Figure 4A:
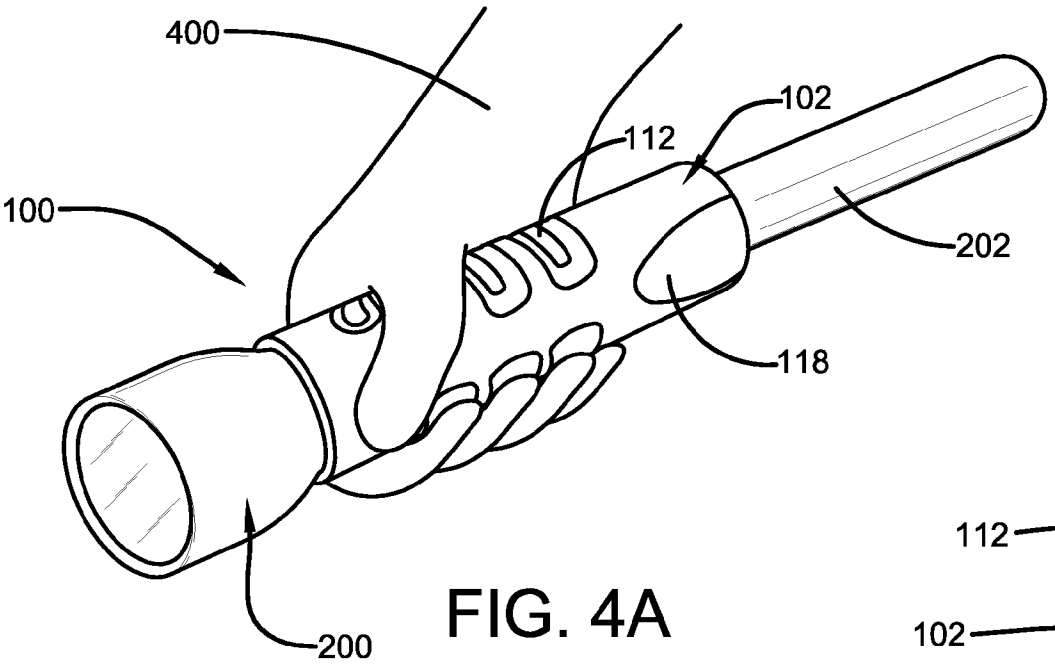
FIG. 4A illustrates a perspective view of a user grasping the gripping device with a right hand in accordance with the disclosed architecture.
Figure 4B:
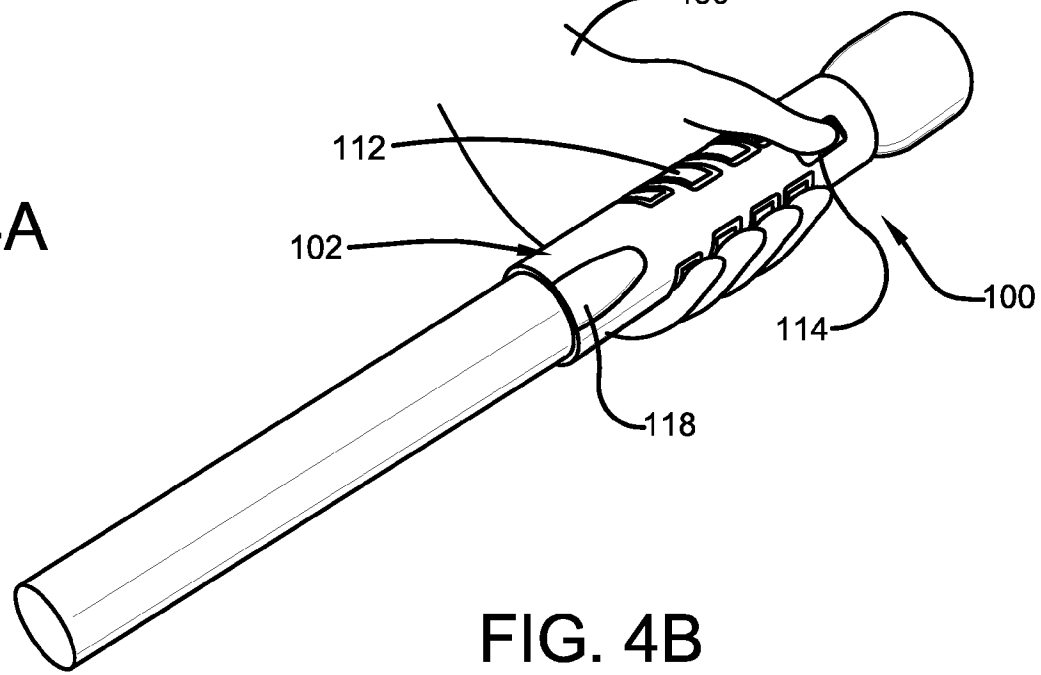
FIG. 4B illustrates a perspective view of a user grasping the gripping device with a left hand in accordance with the disclosed architecture.

FIGS. 4A-4B illustrate a user 400 grasping the gripping device 100. As stated supra, the gripping device 100 comprises a flexible sleeve member 102 comprising open, opposed ends and an interior surface 108 and an exterior surface 110. Typically, the flexible sleeve member 102 is tubular or cylindrical in shape and comprises a generally circular outer circumference. The gripping device 100 is expandable for receiving at least a portion of the main body (or barrel) of a flashlight 200. The silicone of the flexible sleeve member 102 insulates the main body 202 of the flashlight 200, allowing a user to have a good tactical grip on the flashlight 200. Further, the flexible sleeve member 102 would be slid into place on the flashlight 200 via soap and water and once dry, would conform to the contours of the flashlight 200.

The exterior surface 110 of the flexible sleeve member 102 comprises a plurality of recessed finger grooves 112 and recessed thumb grooves 114. The recessed finger 112 and thumb 114 grooves provide the flexible sleeve member 102 with an ergonomic shape, that allows a user to easily grip the flashlight 200 (as shown in FIGS. 4A-4B). The plurality of recessed finger 112 and thumb 114 grooves can be positioned in any suitable location on the exterior surface 110 of the flexible sleeve member 102, and in any suitable arrangement that meets the needs and desires of a user. Further, the recessed finger 112 and thumb 114 grooves can be any suitable size as is known in the art, as long as the recessed grooves 112 and 114 are able to cushion the fingers and/or thumb of a user. Additionally, the plurality of recessed finger 112 and thumb 114 grooves are typically arranged on the exterior surface 110 of the flexible sleeve member 102 such that a user is able to use their right hand (as shown in FIG. 4A) or left hand (as shown in FIG. 4B) when gripping the flashlight 200.

Figure 5:
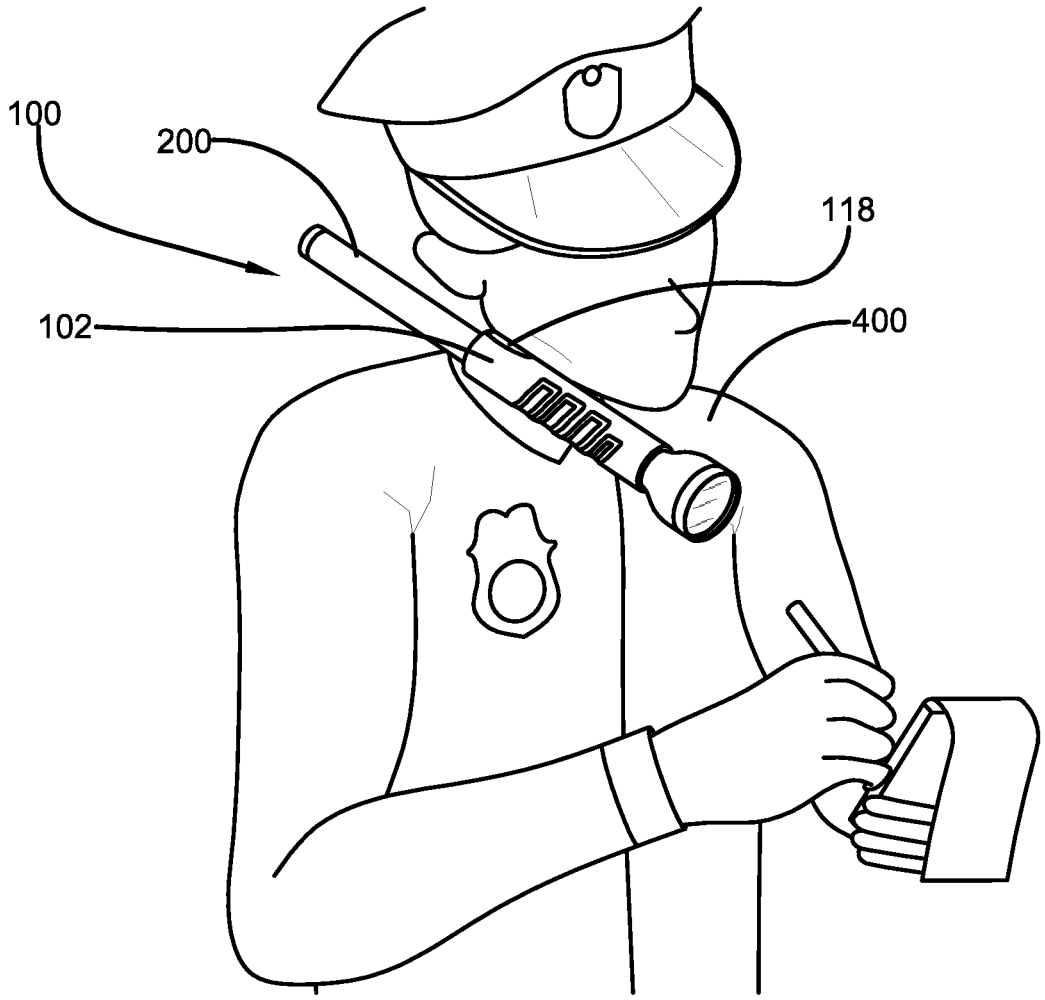
FIG. 5 illustrates a perspective view of the gripping device in use in accordance with the disclosed architecture.

FIG. 5 illustrates the gripping device 100 in use. In operation, a user 400 would choose the color and/or specific design of the flexible sleeve member 102 that meets their needs and/or wants. The user 400 would then determine what flashlight 200 to place the flexible sleeve member 102 on. The user 400 then slides the flexible sleeve member 102 into place on the flashlight 200. Specifically, the user 400 may apply soap and water, or some other lubricant to the main body 202 of the flashlight 200 and then slides the flexible sleeve member 102 into place.

The user 400 would then align the recessed finger 112 and thumb 114 grooves to a desired position on the flashlight 200 via rotating the flexible sleeve member 102 into the desired position. The user would then let the flexible sleeve member 102 dry and once dry, the flexible sleeve member 102 would conform to the contours of the flashlight 200. Further, the textured crosshatch pattern of the interior surface of the flexible sleeve member 102 secures the flexible sleeve member 102 to the main body 202 of the flashlight 200 while in use.

Once secure, the user 400 would then grasp the flashlight 200 via positioning their fingers and thumbs in the recessed grooves of the flexible sleeve member 102, or can place their chin and shoulder against the smooth cushioned area 118 of the flexible sleeve member 102 (as shown in FIG. 5). The user 400 can then utilize the flashlight 200 as usual. Thus, the gripping device 100 provides users 400 with an easy, insulated, and comfortable way to get a good tactical grip on the flashlight 200, and can allow users, particularly security personnel not permitted to carry a firearm, to grip the flashlight 200 quickly and firmly in any self-defense situation and for use as a weapon.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A gripping device for a flashlight having a main body comprising:

a flexible sleeve member comprising a first open end, an opposed second open end, an interior surface and an exterior surface; and wherein the flexible sleeve member is expandable for receiving at least a portion of the main body of the flashlight; and wherein the exterior surface comprises a plurality of recessed finger and thumb grooves; and wherein the plurality of recessed finger and thumb grooves further comprise glow-in-the-dark phosphorescent cell inlays and a smooth cushioned area positioned on the exterior surface for allowing a user to hold the flashlight between a chin and a shoulder.

2. The gripping device of claim 1, wherein the interior surface comprises a textured pattern which secures the flexible sleeve member to the main body of the flashlight.

3. The gripping device of claim 1, wherein the plurality of recessed finger and thumb grooves comprise a gelatinous substance.

4. The gripping device of claim 1, wherein the flexible sleeve member is comprised of silicone.

5. The gripping device of claim 1, wherein the flexible sleeve member comprises a generally circular outer circumference.

6. A gripping device for a flashlight comprising:

a flexible sleeve member comprising a first open end, an opposed second open end, an interior surface and an exterior surface; and a plurality of recessed finger and thumb grooves positioned on the exterior surface; and wherein the flexible sleeve member is expandable for receiving at least a portion of a main body of the flashlight; and wherein the plurality of recessed finger and thumb grooves further comprise glow-in-the-dark phosphorescent cell inlays and a smooth cushioned area positioned on the exterior surface for allowing a user to hold the flashlight between a chin and a shoulder; and wherein the interior surface comprises a textured pattern which secures the flexible sleeve member to the main body of the flashlight.

7. The gripping device of claim 6, wherein the plurality of recessed finger and thumb grooves comprise a gelatinous substance.

8. The gripping device of claim 6, wherein the flexible sleeve member is comprised of silicone.

9. The gripping device of claim 6, wherein the flexible sleeve member comprises a generally circular outer circumference.

10. A gripping system comprising:

a flashlight comprising a main body and an illumination end; and a gripping device comprising a flexible sleeve member; and where the flexible sleeve member comprises a first open end, an opposed second open end, an interior surface and an exterior surface; and a plurality of recessed finger and thumb grooves positioned on the exterior surface; and wherein the flexible sleeve member is expandable for receiving at least a portion of the main body of the flashlight; and wherein the plurality of recessed finger and thumb grooves comprise glow-in-the-dark phosphorescent cell inlays and a smooth-cushioned area positioned on the exterior surface for allowing a user to hold the flashlight between a chin and a shoulder.

11. The gripping system of claim 10, wherein the interior surface comprises a textured pattern which secures the flexible sleeve member to the main body of the flashlight.

12. The gripping system of claim 10, wherein the flashlight is a D-cell powered, long-handled flashlight.

* * * * *